United States Patent [19]

Serber

[11] Patent Number: 4,493,393

[45] Date of Patent: Jan. 15, 1985

[54] MECHANIC'S REST

[76] Inventor: Hector Serber, 40 Old Ranch Rd., Novato, Calif. 94947

[21] Appl. No.: 529,518

[22] Filed: Sep. 6, 1983

[51] Int. Cl.[3] ..... A47C 16/00

[52] U.S. Cl. ..... 182/129; 182/230; 108/44

[58] Field of Search ..... 182/230, 116, 129, 222, 182/179; 108/44, 45; 297/4, 423

[56] References Cited

U.S. PATENT DOCUMENTS 2,510,436 6/1950 Trammell ..... 108/45
3,071,410 1/1963 Gaskins ..... 297/195
3,330,227 7/1967 Yachuk ..... 108/44
3,698,330 10/1972 Krombach ..... 108/44

*Primary Examiner*—Reinaldo P. Machado
*Attorney, Agent, or Firm*—Melvin R. Stidham

[57] ABSTRACT

The invention comprises a portable, compact and lightweight mechanic's rest, consisting of a chest support platform, itself supported by front and rear leg members, upon which a user can lean or rest while working on an auto engine or other object. The chest support platform is shaped to comfortably fit the user's chest area, and the leg members can swivel and adjust in length to contact any stable structural member on or near the object being worked on.

9 Claims, 2 Drawing Figures

MECHANIC'S REST

BACKGROUND OF THE INVENTION

Auto mechanics, and others who must lean over to perform their work, frequently suffer from back strain resulting from their awkward working position. Various scaffold-type devices have been developed to provide support for such a user. Most of these devices are designed specifically for auto mechanics, and consist of a platform attached to a framework that stands on the floor, typically including casters for mobility.

As a result of their design, such devices are often inappropriate or unusable for certain applications. For instance, in especially close quarters, there is insufficient room to allow their bulky framework. Furthermore, where there is no floor on which the framework can stand, as in the case of working over an inboard boat engine, these devices cannot be used at all.

OBJECTS OF THE INVENTION

It is an object of this invention to provide a mechanic's rest that can be used in practically any area in which a mechanic might have to work.

It is a further object of this invention to provide a mechanic's rest that does not require accessibility to a floor on which to place its framework.

It is a further object of this invention to provide a mechanic's rest that is portable, compact, lightweight and easily assembled.

Other objects and advantages of this invention will become apparent from the description to follow, particularly when read in conjunction with the accompanying drawings.

SUMMARY OF THE INVENTION

The mechanic's rest of this invention comprises a portable chest support platform, shaped and contoured for a comfortable fit to a human torso, upon which a mechanic can rest while working on an engine or other object. This chest support platform is itself supported at the front and rear by adjustable leg members, which can swivel and/or extend to contact any appropriately stable structural member or component on or near the object being worked on. This design permits use of the unit in extremely close quarters, and does not require accessibility to a floor on which to place the legs.

DETAILED DESCRIPTION OF A PREFERRED EMBODIMENT

Figure 1:
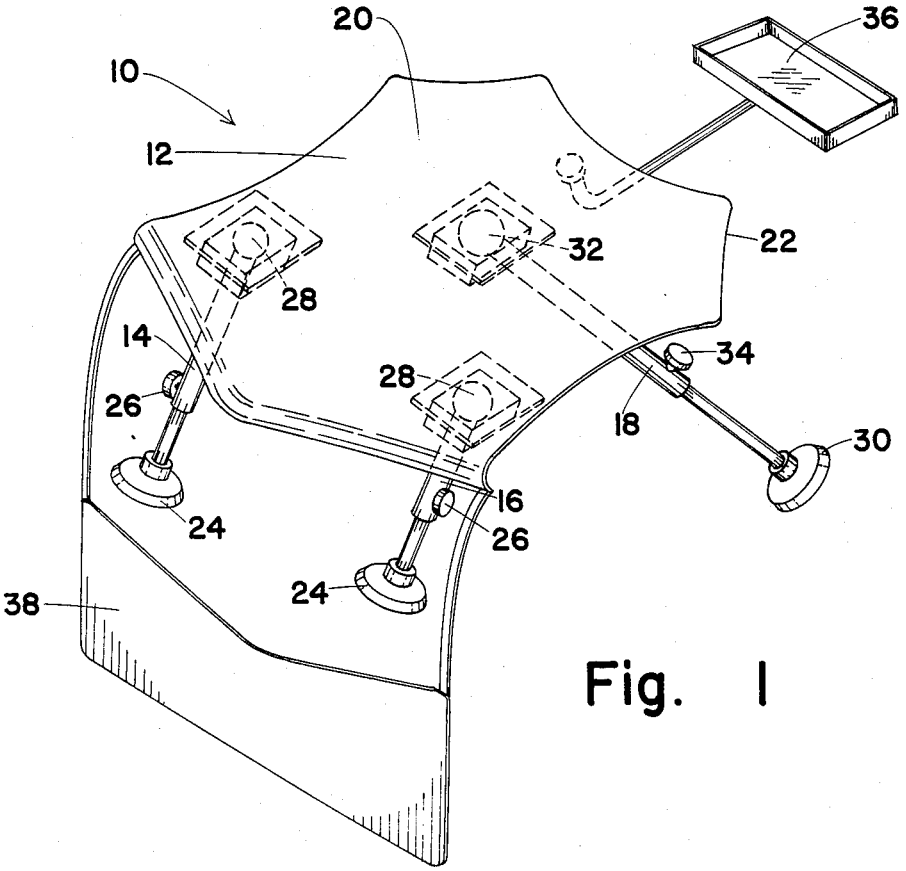
FIG. 1 is a perspective view of the mechanic's rest.

Referring now to FIG. 1 with greater particularity, the mechanic's rest 10 of this invention comprises a chest support platform 12, borne by and attached to rear strut or leg members 14 and 16 and front strut or leg member 18. Chest support platform 12 is preferably constructed of lightweight, moldable or shapeable material, such as plastic or wood, of a size to generally fit the frontal area of a typical human torso. It is preferably slightly concave on its upper surface 20, to comfortably fit the contours of a human chest area. Its length and width, and the shape of its peripheral edge 22, are chosen to support the entire chest area, without interfering with the arm, leg or head movement of the user.

Rear leg members 14 and 16 are attached to the underside of chest support platform 12 near its posterior (or, bottom of chest area) end, and terminate in suction cup or cushion members 24, which are designed to rest upon some solid surface on or near the object to be worked on, such as an automobile fender. These rear leg members may include a height adjustment means 26, such as a lockable cam or telescoping tube arrangement, and/or an angle adjustment means 28, such as a locking type ball and socket joint.

Front leg member 18 is attached to the underside of chest support platform 12 near its anterior (or, top of chest area) end, and terminates in suction cup or cushion member 30. Front leg member 18 may incorporate a swivel mechanism 32, such as a locking type ball and socket joint, to permit orientation and placement of cushion 30 on a suitable resting point on or near the object being worked on. For example, with rear leg members 14 and 16 placed on an auto fender, front leg member 18 might be oriented to contact and rest upon the engine block or mount, thereby supporting the user directly over the engine. Extension means 34, such as a lockable telescoping tube arrangement, permits further versatility in such orientation and placement.

Optional features that could be incorporated onto the mechanic's rest include a removable parts tray 36, for convenient placement of tools, parts and the like. Apron 38 serves to protect the object being worked on from scratches or dents, as in the case of an automobile fender.

Figure 2:
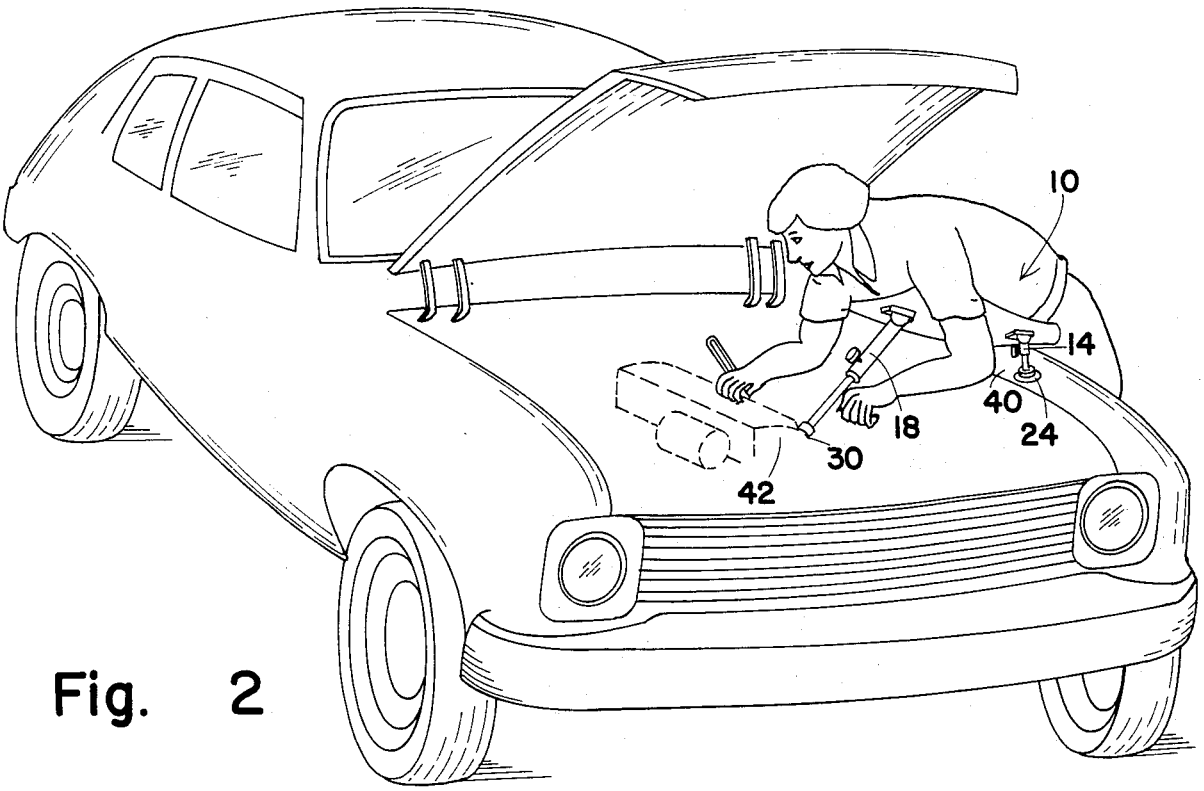
FIG. 2 is a view of the mechanic's rest as used in an automobile engine repair application.

Referring now to FIG. 2 with greater particularity, mechanic's rest 10 is shown as it might be used by an auto mechanic working on an auto engine. In this case, cushion 24 of rear leg member 14 is shown contacting the automobile fender 40, while cushion 30 of front leg member 18 is being supported by the automobile engine 42.

While this invention has been described in conjunction with a preferred embodiment thereof, it is obvious that modifications and changes therein may be made by those skilled in the art to which it pertains without departing from the spirit and scope of this invention, as defined by the claims appended hereto.

What is claimed as invention is:

1. A mechanic's rest comprising:

a chest support platform of a size to generally fit the frontal area of a typical human torso, gently concave and contoured on its upper surface to approximate the shape of such a torso with forward corners removed to facilitate arm movement;

cushioned lower support means attached to the underside of said chest support platform along the rear edge thereof;

a single front leg;

a ball and socket joint mounting said front leg to swivel to the underside of said chest support platform intermediate the sides thereof; and extensible means for adjusting the length of said front leg.

2. The mechanic's rest described in claim 1 wherein said extensible means comprises:

a telescoping tube.

3. The mechanic's rest described in claim 1 including:

a pivotal means attaching said rear leg means to said platform.

4. The mechanic's rest described in claim 3 wherein said pivotal means comprises:

a ball and socket joint.

5. The mechanic's rest described in claim 1 including:

extensible means for adjusting the length of said rear leg means.

6. The mechanic's rest described in claim 5 wherein said extensible means comprises:

a telescoping tube.

7. The mechanic's rest described in claim 1 including:

a parts tray attached to the anterior end of said chest support member.

8. The mechanic's rest described in claim 1 including:

an apron of flexible material attached to the posterior of said chest support platform to cover and protect the fender of a car.

9. The mechanic's rest described in claim 1 wherein said chest support platform is constructed of molded plastic.

* * * * *